US012290850B2

(12) United States Patent
Del Fabro

(10) Patent No.: US 12,290,850 B2
(45) Date of Patent: May 6, 2025

(54) MACHINE FOR WORKING BARS AND CORRESPONDING WORKING METHOD

(71) Applicant: M.E.P. MACCHINE ELETTRONICHE PIEGATRICI S.P.A., Reana del Rojale (IT)

(72) Inventor: Giorgio Del Fabro, Udine (IT)

(73) Assignee: M.E.P. MACCHINE ELETTRONICHE PIEGATRICI S.P.A., Reana del Rojale (IT)

( * ) Notice: Subject to any disclaimer, the term of this patent is extended or adjusted under 35 U.S.C. 154(b) by 248 days.

(21) Appl. No.: 17/428,925

(22) PCT Filed: Feb. 5, 2020

(86) PCT No.: PCT/IT2020/050020
§ 371 (c)(1),
(2) Date: Aug. 5, 2021

(87) PCT Pub. No.: WO2020/161758
PCT Pub. Date: Aug. 13, 2020

(65) Prior Publication Data

US 2022/0126346 A1 Apr. 28, 2022

(30) Foreign Application Priority Data

Feb. 5, 2019 (IT) ..... 102019000001631

(51) Int. Cl.
*B21D 7/022* (2006.01)
*B21D 7/08* (2006.01)
(Continued)

(52) U.S. Cl.
CPC ..... *B21D 7/022* (2013.01); *B21D 7/08* (2013.01); *B21D 11/12* (2013.01); *B21F 1/004* (2013.01)

(58) Field of Classification Search
CPC . B21D 7/022; B21D 7/08; B21D 7/02; B21D 7/024; B21D 7/04; B21D 11/12; B21F 1/004
(Continued)

(56) References Cited

U.S. PATENT DOCUMENTS 6,446,484 B1 9/2002 Anderson et al.

FOREIGN PATENT DOCUMENTS

CN 108160772 A 6/2018
EP 0427038 A1 * 5/1991
(Continued)

OTHER PUBLICATIONS

International Search Report of PCT/IT2020/050020 dated May 19, 2020 (3 pages).
(Continued)

*Primary Examiner* — Jimmy T Nguyen
*Assistant Examiner* — Teresa A Guthrie
(74) *Attorney, Agent, or Firm* — Calfee, Halter & Griswold LLP

(57) ABSTRACT

Machine for working bars, suitable for working at least one bar having a mainly oblong development; the machine comprises at least two support sliders, of which at least one is mobile reciprocally toward/away from the other along an axis of movement and each provided with a work plane on which at least one curving unit is installed, suitable to curve at least a longitudinal portion of said bar, and at least a first bending unit, provided with a first contrast element having a first bending radius, and with a first bending element selectively rotatable about said first contrast element in order to bend said bar around the latter.

7 Claims, 3 Drawing Sheets

(51) Int. Cl.
*B21D 11/12* (2006.01)
*B21F 1/00* (2006.01)

(58) Field of Classification Search
USPC ..... 72/171, 173, 174
See application file for complete search history.

(56) References Cited

FOREIGN PATENT DOCUMENTS

| | | | | | |
|---|---|---|---|---|---|
| WO | WO-2009135845 | A1 * | 11/2009 | ..... | B21D 11/12 |
| WO | WO-2012143776 | A1 * | 10/2012 | ..... | B21D 11/12 |
| WO | 2017033145 | A1 | 3/2017 | | |

OTHER PUBLICATIONS

Written Opinion of the International Search Authority of PCT/IT2020/050020 dated May 19, 2020(7 pages).

* cited by examiner

MACHINE FOR WORKING BARS AND CORRESPONDING WORKING METHOD

CROSS-REFERENCE TO RELATED APPLICATIONS

This application is a 371 of PCT Application No. PCT/IT2020/050020, filed on Feb. 5, 2020, which claims priority to Italian Application No. 102019000001631, filed on Feb. 5, 2019, the contents of which are hereby incorporated by reference as if recited in their entirety.

FIELD OF THE INVENTION

The present invention concerns a machine for working bars suitable for bending and/or curving bars or, in general, products with an oblong shape such as rod, round pieces, square pieces having a circular, polygonal or flat cross section shape.

By way of example only, the machine for working bars can bend and/or curve rod, fed in the form of a bar or in the form of a coil or coming from a center for cutting straight bars.

BACKGROUND OF THE INVENTION

In the field of building and road construction, and not only, the need to use bars made of metal material, such as iron, steel or other alloy with suitable characteristics, is known, in order to reinforce concrete structures, making it a so-called "reinforced" structure.

These bars, more commonly known as reinforcement rods, that is, rods used to reinforce concrete, often require shaping in advance, that is, advance bending and curving, to achieve the shape and profile of the concrete structure that they have to contribute to reinforce. By curving we generally mean a deformation of all or part of the longitudinal extension of the bar, while by bending we generally mean a deformation localized in a specific zone of the bar.

The reinforcement rods can have a round section or a round section with ridges and ribs able to facilitate anchoring with the concrete and, once suitably shaped, they can be connected together in a known way to create the desired reinforcement structures.

For this purpose, machines for working bars are known which are suitable for curving and/or bending bars such as rod, round pieces, square pieces having a circular, polygonal or flat cross section shape. Machines of this type are described, for example, in the international patent WO 2017/033145 A1, in the name of the Applicant.

WO 2017/033145 A1 describes a combined machine for curving and bending rod which comprises a support base configured to support and guide, along an axis of movement, two mobile sliders on each of which a work plane is installed. The work plane is provided with a bending unit and a curving unit respectively suitable to bend and curve at least a portion of one or more of the worked rods.

In particular, the bending unit comprises a contrast roller and a bending roller between which, during use, the bar is made to pass, on one or more portions of which a bending is made having a bending radius corresponding to the radius of the contrast roller.

Although this combined machine is very efficient because it provides the combined use of a bending unit and a curving unit, it nevertheless allows the bending of the bar with a single radius of curvature corresponding to the radius of the contrast roller at that moment equipped on the machine, while, in this specific field, it is often required that the same bar must be bent with different bending radii, to meet the structural requirements described above, and therefore the machine must be, on each occasion, equipped with bending units suitable to obtain such bending radii.

This naturally entails a certain waste of time and a certain slowness in the production of bars with different bending radii, due to the continuous re-equipping of the machine with different bending units or to the need to perform the bending operations on different machines, therefore moving the bars from one machine to another. Furthermore, the operator often has to perform partial workings on one batch of bars, re-equip the machine, carry out further partial workings on the entire batch of bars or on part of it and so on until the end of the bending operations to be carried out.

In addition, the continuous re-equipping of the machine entails possible assembly errors of the bending units which, incorrectly installed, can cause precision errors in the bending operations as well as safety problems for operators, who are more often called upon to intervene on the machine.

There is therefore a need to perfect a machine for working bars which can overcome at least one of the disadvantages of the state of the art.

One purpose of the present invention is to provide a machine for working bars which allows bending operations characterized by different bending radii to be carried out without requiring the continuous re-equipping of the machine.

Another purpose of the present invention is to provide a machine for working bars which allows to simplify the execution of different bending operations to be carried out on the same bar.

A further purpose of the present invention is to provide a machine for working bars which allows to reduce the execution times of different bending operations.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

Embodiments described here concern a machine for working bars.

The machine for working bars is suitable for working at least one bar having a mainly oblong development.

The machine comprises at least two support sliders, of which at least one is reciprocally mobile toward/away from the other along an axis of movement.

The support sliders are each provided with a work plane on which at least one curving unit is installed, suitable for curving at least a longitudinal portion of the bar, and at least one first bending unit.

The first bending unit is provided with a first contrast element having a first radius of curvature and a first bending element selectively rotatable about the first contrast element in order to bend the bar around the latter.

According to one aspect of the present invention, at least one of the support sliders comprises at least a second bending unit on the work plane.

The second bending unit is provided with a second contrast element and a second bending element selectively rotatable about the second contrast element to bend the bar around the latter.

The second contrast element has a different bending radius from the first bending radius of the first contrast element of the first bending element.

Advantageously, in this way, in a same work machine it is possible to perform a plurality of bends on the same bar without needing to perform said bends in different work machines, therefore requiring the movement of the bar, or without needing to re-equip the machine with a bending unit different from the one already installed.

The invention also concerns a method for working at least one bar in a work machine, in particular a method which provides at least one curving operation for at least one bar and two or more bending operations on the bar with different radii of curvature.

These and other aspects, characteristics and advantages of the present disclosure will be better understood with reference to the following description, drawings and attached claims. The drawings, which are integrated and form part of the present description, show some embodiments of the present invention, and together with the description, are intended to describe the principles of the disclosure.

The various aspects and characteristics described in the present description can be applied individually where possible. These individual aspects, for example aspects and characteristics described in the attached dependent claims, can be the object of divisional applications.

It is understood that any aspect or characteristic that is discovered, during the patenting process, to be already known, shall not be claimed and shall be the object of a disclaimer.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
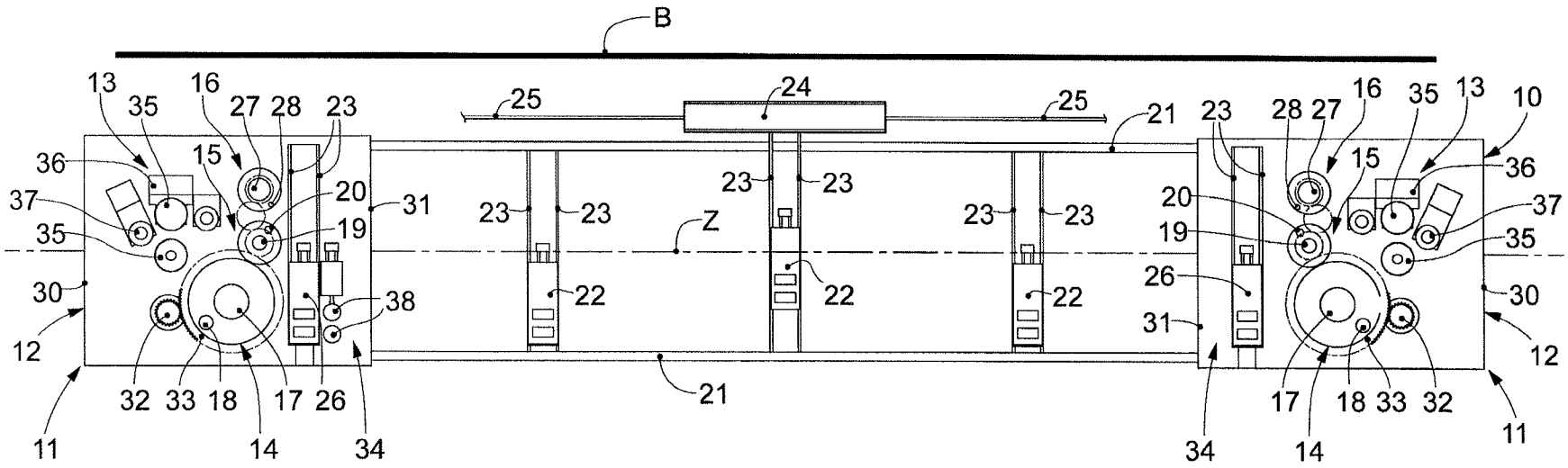
FIG. 1 shows schematically a machine for working bars according to the present invention.

We will now refer in detail to the various embodiments of the present invention, of which one or more examples are shown in the attached drawings.

Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall comprise all such modifications and variants.

Before describing these embodiments, we must also clarify that the present description is not limited in its application to details of the construction and disposition of the components as described in the following description using the attached drawings. The present description can provide other embodiments and can be obtained or executed in various other ways. We must also clarify that the phraseology and terminology used here is for the purposes of description only, and cannot be considered as limitative.

Embodiments described using the attached drawings concern a machine for working bars, indicated as a whole with the reference number 10 in the attached drawings.

The machine 10 is suitable for working at least one bar B, having a mainly oblong development.

The bar B can be supplied to the machine 10 directly in the form of a bar or in the form of a coil to be straightened and cut to size, or it can come from a center for cutting straight bars.

Depending on the final product to be obtained, the bars B to be supplied to the machine 10 can also be of different types, for example of different diameters, materials, surface working or other.

In accordance with some embodiments, the machine 10 comprises at least two support sliders 11, at least one of which is reciprocally mobile toward/away from the other along an axis of movement Z, and each provided with a work plane 12.

On the work plane 12 at least a curving unit 13 is installed, suitable for curving at least a longitudinal portion of the bar B, and at least a first bending unit 14, provided with a first contrast element 17, having a first bending radius R1, and a first bending element 18.

Figure 2:
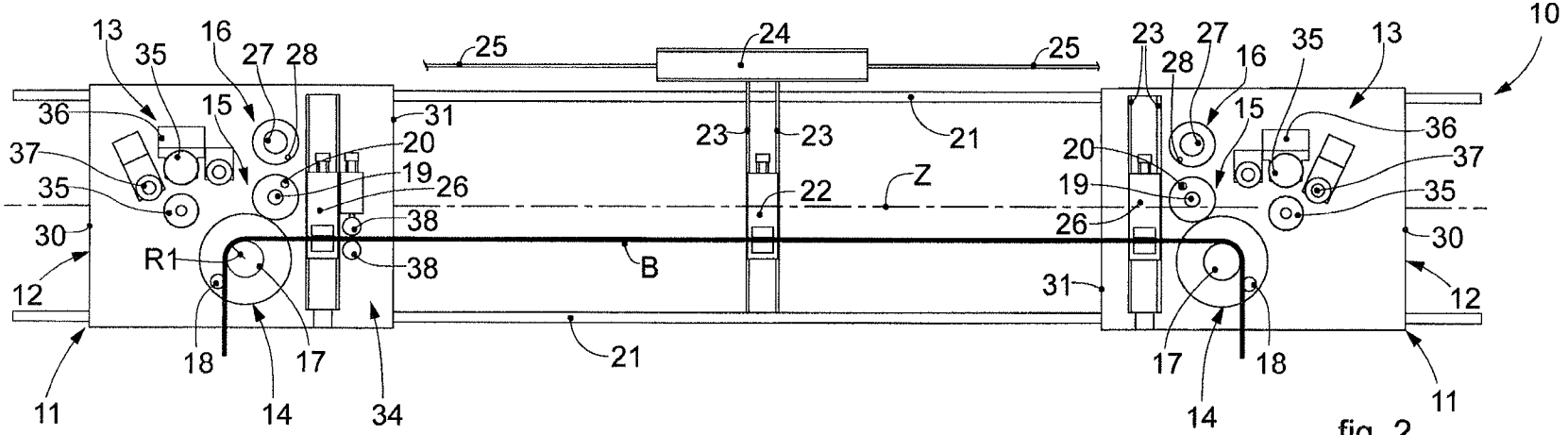
FIGS. 2-4 show the machine of FIG. 1 during the bending operations of a bar.

The first contrast element 17 is provided with at least a shaped portion with an arched profile characterized by said bending radius R1, shown in FIG. 2.

The first bending element 18 can be selectively rotated about the first contrast element 17 to bend the bar B around it.

In accordance with one aspect of the present invention, at least one of the support sliders 11 comprises on the work plane 12 at least a second bending unit 15, 16 provided with a second contrast element 19, 27 and a second bending element 20, 28.

Figure 3:
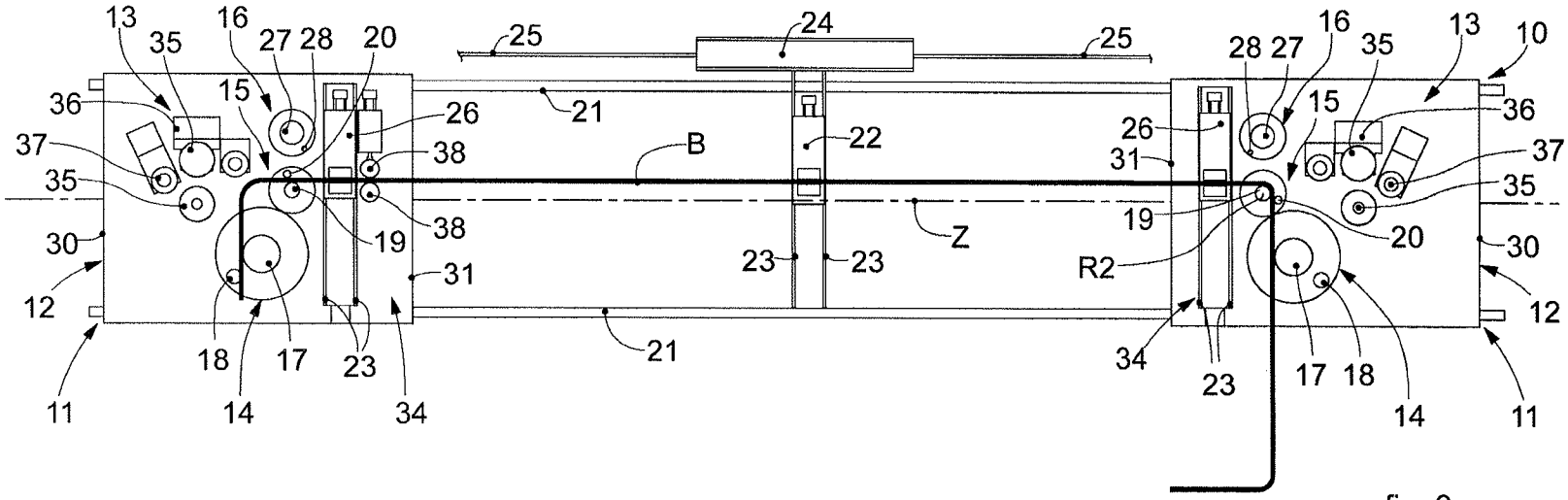
Figure 4:
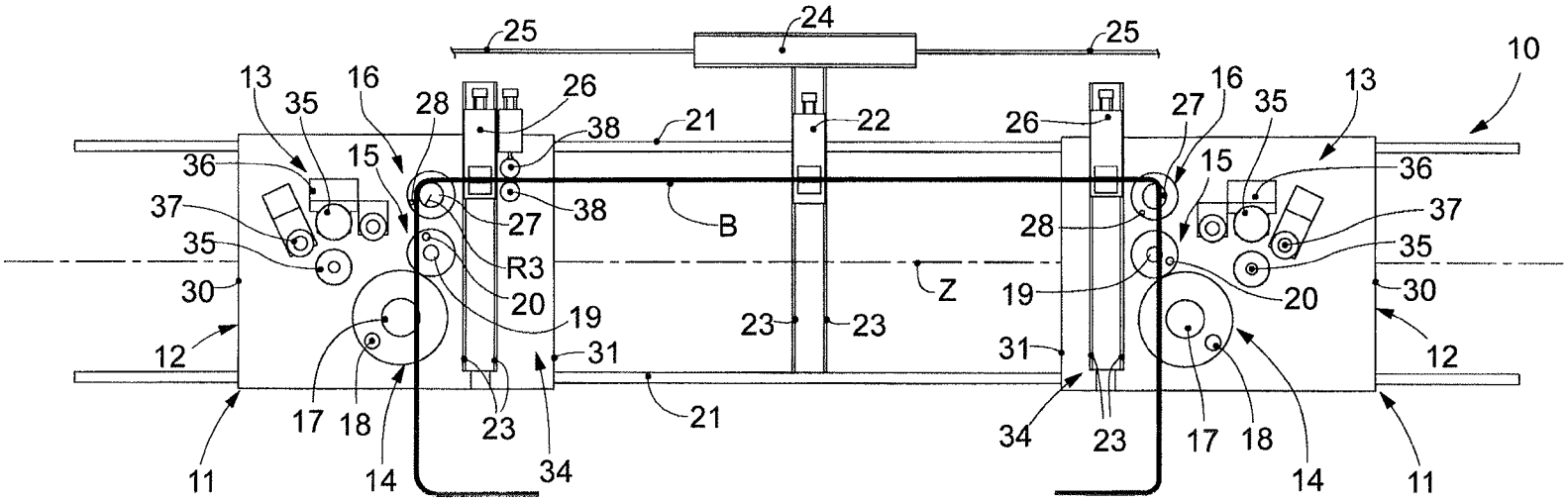

The second contrast element 19, 27 is also provided with at least one shaped portion with an arched profile characterized by bending radii R2, R3, shown respectively in FIG. 3 and FIG. 4.

The second bending element 20, 28 can be selectively rotated about the second contrast element 19, 27 to bend the bar B around it.

The second contrast element 19, 27 has a bending radius R2, R3—respectively shown in FIG. 3 and FIG. 4—different from the bending radius R1, shown in FIG. 2, of the first contrast element 17 to make bends on the bar B with different bending radii.

This solution allows operators to equip the machine 10 in advance with contrast elements and bending elements of suitable size for bending the bar B without requiring interruptions during working, for example for the replacement of one or more contrast elements or one or more bending elements.

Furthermore, this solution allows to perform on the same bar B, in addition to curving operations, also bending operations with different bending radii, for example with a first bending radius R1 and a second bending radius R2, without requiring any moving or removal of the bar B from the machine 10.

Here and hereafter in the description, reference will be made to the working of a single bar B, although it is clear that the machine 10 can work several B bars simultaneously.

In accordance with the embodiment shown in FIGS. 1-5, the support sliders 11 are positioned facing each other and can slide on guides 21 parallel to each other and with respect to the axis of movement Z as above.

In particular, the support sliders 11 are mobile along the axis of movement Z independently in relation to the specific operations to be performed on the bar B.

The guides 21 can have a length, in the direction of the axis of movement Z, compatible with the maximum length of the bars B that can be worked by the machine 10, in which case the support sliders 11 can be at the opposite ends of the guides 21.

The machine 10 also comprises holding means 22 positioned between the support sliders 11 and configured to support and hold the bar B while it is being worked. The holding means 22 prevent unwanted flexions of the bar B in a central portion which, due to its own weight, would tend to deform.

The holding means 22 are configured to act on the bar B, as described above, on a plane coplanar with the work plane 12, preventing deformations of the bar B due to interference with the work plane 12.

Furthermore, in relation to the length of the bar B which they have to support, there can be one or more than one holding means 22.

In accordance with the embodiment shown in FIG. 1, the holding means 22 comprise at least one central holding mean 22, that is, configured to hold a central portion of the bar B. In particular, the central holding mean 22 can be moved and positioned in a first direction, orthogonal to the axis of movement Z, and in a second direction, coincident or parallel to the axis of movement Z.

There are preferably at least three holding means, therefore two other lateral holding means 22 are positioned on the sides of the central holding mean 22, and are preferably symmetrical with respect to the central holding mean 22.

Advantageously, the movement of the central holding mean 22 with respect to the second direction as above allows the latter to support the bar B always on its central portion, regardless of the reciprocal distance between the support sliders 11.

The lateral holding means 22 can only be moved in directions parallel to the first direction orthogonal to the axis of movement Z. The lateral holding means 22 are auxiliary to the central holding mean 22 if the bar B is very long, that is, in the event that the support sliders 11 are very far apart, for example at the opposite ends of the guides 21.

The holding means 22 are configured to move parallel to the first direction by means of sliding guides 23. The central holding mean 22 is also configured to move in the second direction by means of a transfer device 24 mobile on sliding guides 25.

Operationally, if it is necessary to support the bar B with more than one holding mean 22, these must be aligned in a transverse direction, perpendicular to the axis of movement Z, to avoid generating stresses and deformations on the bar B in the transverse direction.

In some embodiments, the holding means 22 can be of the "vice" type, that is, comprising two symmetrical jaws mobile with respect to the first direction. The jaws define a variable passage gap between them, to hold and release the bar B.

When the bar B is fed to the machine 10, in a known manner, it can be supported by the holding means 22 and can be partly rested on the work planes 12 of the support sliders 11.

In accordance with the embodiment shown for example in FIG. 1, each work plane 12 comprises the curving unit 13, first bending unit 14 and second bending unit 15 as above.

By curving, here and hereafter in the description, we mean that the bar B is subjected to a continuous deformation for an extended longitudinal portion of the length of the bar B or for its entire length. During a curving operation, the curving unit 13 is driven to deform the bar B while one or both of the support sliders 11 move in the direction of the axis of movement Z.

By bending, here and hereafter in the description, we mean that the bar B is subjected to a deformation localized only in the zone where the bending unit chosen for the operation acts, for example, in FIG. 2, the first bending unit 14. During a bending operation, one of the bending units 14, 15 is operated to deform the bar B while the support sliders 11 are stopped.

In accordance with the embodiment shown in FIGS. 1-5, a third bending unit 16 is also installed on each work plane 12, provided with a third contrast element 27 and a third bending element 28 selectively rotatable about the third contrast element 27 to bend the bar B around it.

The third contrast element 27 has different sizes from the first contrast element 17 and the second contrast element 19, in order to make bends on the bar B with a third bending radius R3, FIG. 4, different from the first bending radius R1, FIG. 2, and from the second bending radius R2, FIG. 3.

In possible embodiments, not shown, it can be provided to install on the work plane 12 a number of bending units even greater than three, for example up to seven and in any case in relation to the space present on the work plane 12.

In the embodiments described using FIGS. 1-5, the curving unit 13 and the bending units 14, 15 are installed in a preferential position so as to facilitate operations and prevent unnecessary interference.

In particular, the curving unit 13 can be installed in a decentered position on the work plane 12 toward a first side 30 of the work plane 12 perpendicular to the axis of movement Z. The bending units 14, 15 can be installed in a decentered position on the work plane 12 toward a second side 31, opposite the first side 30, even if the possibility of a different positioning is not excluded.

In accordance with possible solutions, not shown, the bending units 14, 15 can be installed on the support sliders 11 in non-specular positions, that is, different.

In accordance with possible solutions, the drive of the curving unit 13 and at least of the bending units 14, 15 can be independent or can be carried out with the same motor unit.

In accordance with one aspect of the present invention, shown in FIG. 1, at least one support slider 11 provides a single drive mean configured to drive, simultaneously or sequentially, at least the bending units 14, 15.

The drive mean comprises a motor member, not shown, provided with a pinion 32 which engages with a toothed crown 33.

The toothed crown 33 is associated with the first bending unit 14 and allows the rotation of at least the first bending element 18 with respect to the first contrast element 17.

The first bending unit 14 is kinematically connected to the second bending unit 15 and, when present as in the case shown in FIGS. 1-5, to the third bending unit 16 by means of toothed wheels, schematically shown with "dot-dash" lines, which determine the simultaneous rotation of the bending units 14, 15, 16.

In accordance with some embodiments, at least some of the curving units 13 and/or the bending units 14, 15 can be positioned retracted with respect to the work plane 12 of the respective support slider 11.

In particular, the curving units 13 and the bending units 14, 15 are mobile between a condition protruding from the work plane 12, in which they can act on the bar B, and a position retracted from the work plane 12, in which they are positioned below the work plane 12 and do not interfere with the bar B.

According to a first example, shown in FIG. 2, during the bending of the bar B with the bending unit 14, the latter is in the protruding position as above, while the second bending unit 15, the third bending unit 16 and the curving unit 13 are in the retracted position as above.

According to a second example, shown in FIG. 3, during the bending of the bar B with at least one bending unit, the second bending unit 15 is in the protruding position as above, while the first bending unit 14, the third bending unit 16 and the curving unit 13 are in the retracted position as above.

According to a third example, shown in FIG. 4, during the bending of the bar B with at least one bending unit, the third bending unit 16 is in the protruding position as above, while the first bending unit 14, the second bending unit 15 and the curving unit 13 are in the retracted position as above—

Figure 5:
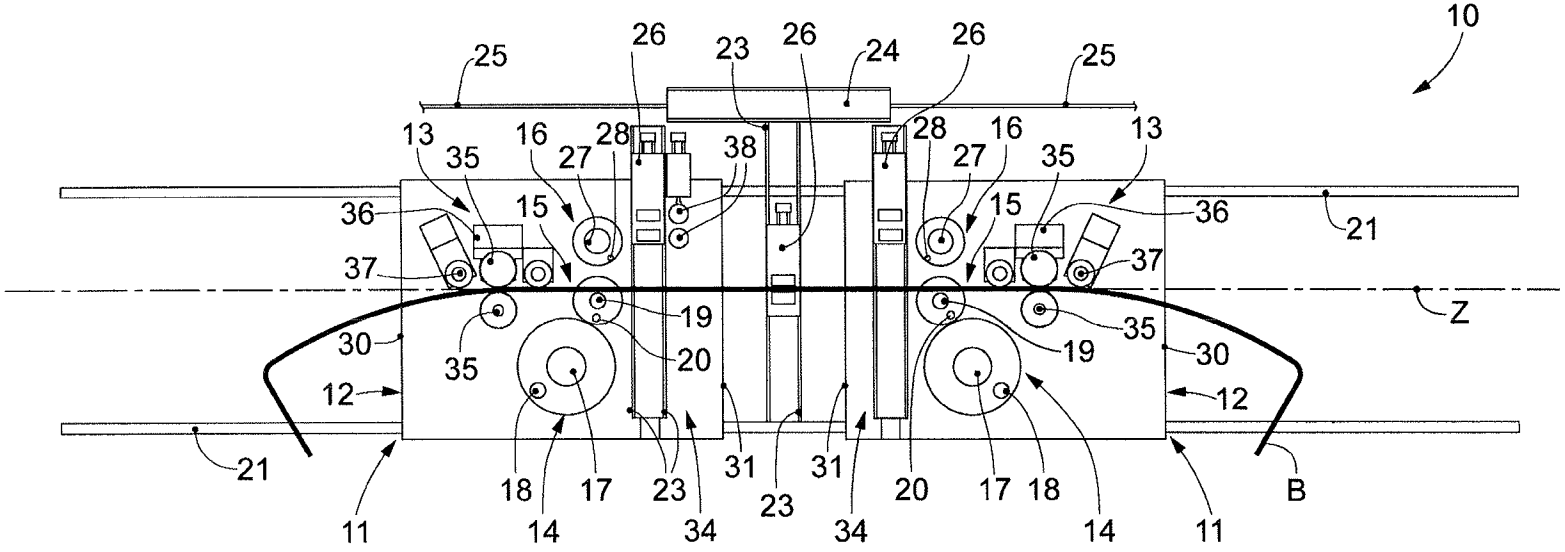
FIG. 5 shows the machine of FIG. 1 during a bar bending operation.

According to a fourth example, shown in FIG. 5, during the bending of the bar B with at least one bending unit, the curving unit 13 is in the protruding position as above, while the first bending unit 14, the second bending unit 15 and the third bending unit 16 are in the retracted position as above.

In accordance with some embodiments, shown in FIGS. 1-5, the curving units 13 comprise two contrast rollers 35 located in a position opposite to each other, at least one contrast roller 35 being advantageously provided with positioning means 36 configured to allow a selective movement away/toward the other contrast roller 35 so as to adjust the gap between them in relation to the bar B.

The curving units 13 can operate on the bar B in a known manner. In the case given by way of example here, shown in FIG. 5, the curving units 13 also comprise a curving roller 37, which can be positioned with respect to the contrast rollers 35 and configured to exert a desired deformation on the bar B.

The position of the curving roller 37 with respect to the contrast rollers 35 determines the curvature of the bar B.

At least the bending units 14, 15 are configured to bend at least one end of the bar B, therefore to perform head and/or tail bending operations, but can also operate in an intermediate position of the bar B.

If one of the bending units 14, 15 as above intervenes in an intermediate position of the bar B, it can intervene after at least a part of the curve has been obtained, or before the curving operation begins.

According to possible solutions, the bending units 14, 15, 16 can be of the type shown in FIGS. 1-5, that is provided with pin-shaped contrast elements 17, 19, 27 and with bending elements 18, 20, 28 of similar shape.

According to a possible variant embodiment, the bending units 14, 15, 16 can comprise hoe-type contrast elements 17, 19, 27.

On each work plane 12 of the support sliders 11 there is also provided a clamping mean 26 suitable to hold at least the portion of bar B during the bending operation. In this way, during the bending operation, the stresses on the bar B are limited to the portion of the bar B to be bent.

The clamping mean 26 is mobile on the work plane 12 in the first direction as above on sliding guides 23, which allow an excursion of the clamping mean 26 such as to guarantee the correct positioning of the bar B for any curving and bending operation whatsoever.

The clamping mean 26 can also be of the "vice" type, as described above for the holding means 22.

In accordance with one aspect of the present invention, the machine 10 comprises a drawing unit 34, installed on at least one support slider 11, and mobile on the work plane 12 in a direction perpendicular to the axis of movement Z. The drawing unit 34 is configured to draw the bar B in the direction of the axis of movement Z or to draw at least one support slider 11 in the same direction.

The drawing unit 34 comprises drawing rollers 38 disposed aligned in a direction orthogonal to the axis of movement Z and defining a variable passage gap between them for the passage of the bar B and for the drawing thereof.

In the event that the support sliders 11 are not provided with autonomous drive means, the support sliders 11 can be moved by the drawing action that the drawing unit 34 exerts on the bar B. For example, in order to move the support slider 11 which does not have the drawing unit 34, the clamping mean 26 of the support slider 11 must necessarily clamp the bar B and the clamping mean 26 of the other support slider 11 must not clamp the bar B. In order to move the support slider 11 that has the drawing unit 34 the relative clamping mean 26 must not clamp the bar B and the clamping mean 26 of the other support slider 11 must clamp the bar B.

In accordance with the embodiment shown in FIGS. 1-5, the drawing unit 34 is associated with the clamping mean 26 and is mobile with the latter.

Even if not shown, the machine 10 can be associated with a programmable control, management, and command unit configured to control, manage and command possible movement elements of the support sliders 11.

In accordance with possible solutions, the movement members of the support sliders 11 can be chosen in a group comprising worm screw mechanisms, rack mechanisms, chain mechanisms, or similar or equivalent movement members.

Embodiments of the present invention also concern a method for working at least one bar B, having a mainly oblong development, in a machine 10 for working bars, comprising:

at least one curving operation on the bar B by means of the curving unit 13, suitable for curving at least a longitudinal portion of the bar B;

at least a first bending operation on the bar B by means of the first bending unit 14, provided with the first contrast element 17 having the first bending radius R1 and the first bending element 18 selectively rotatable about the first contrast element 17; and at least one further bending operation on the bar B by means of the second bending unit 15, 16 provided with the second contrast element 19, 27 and the second bending element 20, 28 selectively rotatable about the second contrast element 19, 27, in order to bend the bar B around it. The second contrast element 19, 27 is provided with a bending radius R2, R3 different from the bending radius R1 of the first contrast element 17, so as to bend the bar B with different bending radii.

It is clear that modifications and/or additions of parts may be made to the machine for working bars as described heretofore, without departing from the field and scope of the present invention.

It is also clear that, although the present invention has been described with reference to some specific examples, a person of skill in the art shall certainly be able to achieve many other equivalent forms of machine for working bars, having the characteristics as set forth in the claims and hence all coming within the field of protection defined thereby.

The invention claimed is:

1. Machine for working bars, suitable for working at least one bar having a mainly oblong development, said machine comprising at least two support sliders, of which at least one is mobile reciprocally toward/away from the other along an axis of movement and each provided with a work plane on which at least one curving unit is installed, suitable to curve at least a longitudinal portion of said bar, and at least a first bending unit, provided with a first contrast element having a first bending radius, and with a first bending element selectively rotatable about said first contrast element to bend said bar around the latter, wherein at least one of said sliders comprises on said work plane at least a second bending unit provided with a second contrast element and a second bending element selectively rotatable about said second contrast element to bend said bar around the latter, said second contrast element having a bending radius different from the first bending radius of said first contrast element, wherein the first and second bending units are fixed in their relative position and only linearly movable with the movement of the respective sliders, wherein said machine further comprises a drawing unit, installed on at least one of said support sliders, and mobile on said work plane in a direction perpendicular to said axis of movement, configured to draw said bar in the direction of said axis of movement and to draw at least one of said support sliders in the same direction;

wherein said drawing unit comprises drawing rollers disposed aligned in a direction orthogonal to said axis of movement (Z) and defining a variable passage gap between them for the passage of said bar (B) and for the drawing thereof;

wherein said drawing unit is associated with a clamping means able to hold at least a portion of the bar during the bending operation and the clamping means is mobile with the bar on the work plane on a sliding guide such as to guarantee correct positioning of the bar for any curving and bending operation; and wherein the drawing unit and the clamping means are configured to be movable together on the work plane in said direction perpendicular to said axis of movement so as to bring the bar in correspondence with one of the bending units and guarantee correct positioning of the bar for any curving and bending operation.

2. The machine as in claim 1, wherein at least some of said curving units and/or of said bending units can be positioned retractable with respect to said work plane of the respective support slider and mobile between a condition protruding from said work plane and a position retracted from said work plane.

3. The machine as in claim 1, wherein at least one of said support sliders provides a single drive means configured to drive, simultaneously or sequentially, at least said bending units.

4. The machine as in claim 3, wherein said drive means comprises a motor member provided with a pinion engaging on a toothed crown, associated with said first bending unit, and allows the rotation at least of said first bending element with respect to said first contrast element.

5. The machine as in claim 1, further comprising central holding means to hold the bar, in which said central holding means allows to hold a central portion of the bar and can be moved and positioned in a first direction, orthogonal to said axis of movement, and in a second direction, coincident or parallel to said axis of movement.

6. The machine as in claim 5, further comprising lateral holding means lateral to said central holding means and mobile only in directions orthogonal to said axis of movement.

7. A method for working at least one bar in a work machine as in claim 1 and having a mainly oblong development, comprising:

at least one operation to curve the bar by means of said curving unit, suitable to curve at least the longitudinal portion of said bar;

at least one operation to bend the bar by means of said first bending unit, provided with the first contrast element having the first bending radius, and with the first bending element selectively rotatable about said first contrast element; and at least another operation to bend the bar by means of said second bending unit provided with the second contrast element and with the second bending element selectively rotatable about said second contrast element in order to bend said bar around the latter, said second contrast element having the different bending radius from the first bending radius of said first contrast element, so as to bend the bar with different bending radiuses.

* * * * *